US006061981A

United States Patent [19]

Nieves

[11] Patent Number: 6,061,981

[45] Date of Patent: May 16, 2000

[54] AIR CONDITIONER COVER

[76] Inventor: Orlando Nieves, 20 Universal Ave., Iselin, N.J. 08830

[21] Appl. No.: 09/060,024

[22] Filed: Apr. 14, 1998

[51] Int. Cl.[7] ..... E04B 1/38

[52] U.S. Cl. ..... 52/202; 52/511; 52/208; 62/262

[58] Field of Search ..... 52/202, 511, 208; 62/262, 259.1; 312/100, 101

[56] References Cited

U.S. PATENT DOCUMENTS

| | | | |
|---|---|---|---|
| D. 246,379 | 11/1977 | Mueller . | |
| 2,961,846 | 11/1960 | Federico . | |
| 3,364,639 | 1/1968 | Davenport | 52/511 |
| 4,325,229 | 4/1982 | DeZurik . | |
| 4,332,114 | 6/1982 | Goebel . | |
| 4,389,827 | 6/1983 | Valkenburg | 52/511 |
| 4,607,500 | 8/1986 | Bolton et al. | 62/262 |
| 4,658,555 | 4/1987 | Steiner | 52/202 |
| 4,759,194 | 7/1988 | Shapiro | 62/262 |
| 5,125,197 | 6/1992 | Fuchs . | |
| 5,475,955 | 12/1995 | Dickinson | 52/202 |
| 5,815,996 | 10/1998 | Granger | 52/202 |

*Primary Examiner*—Carl D. Friedman
*Assistant Examiner*—Jennifer I. Thissell
*Attorney, Agent, or Firm*—Goldstein & Canino

[57] ABSTRACT

An air conditioner cover, for covering an air conditioner having an air conditioner face, comprising a main housing defining a main cavity which is sized to cover a portion of the air conditioner rearward of the air conditioner face. The main housing has a front panel, four peripheral walls, and a mouth opening opposite the front panel. A flange extends perpendicular to the peripheral walls at the mouth opening. A seal comprising four angled gaskets extends around the mouth opening, each angled gasket extending from one of the peripheral walls and having a triangular cross section. The angled gaskets allow the air conditioner to easily slide into the mouth opening until the air conditioner face meets the front panel, but resists removal therefrom, to hold the air conditioner cover securely upon the air conditioner. The front panel has a decorative covering to match the decor of the room in which the air conditioner is located.

5 Claims, 3 Drawing Sheets

AIR CONDITIONER COVER

BACKGROUND OF THE INVENTION

The invention relates to an air conditioner cover. More particularly, the invention relates to an insulated cover which may be placed over an air conditioner during the winter, which both insulates the air conditioner and provides a decorative appearance therefor.

Conventional "window" air conditioners are either mounted in a window, or in a sleeve above or below the window. Most air conditioners are designed to maximize air flow, so as to more efficiently remove the heat from the room where it is located, and eliminate the heat to the outside. However, these same superior air flow characteristics are undesirable during the winter, when drafty cold air easily travels through the air conditioner, as if it were simply an open window.

Thus, homeowners and apartment dwellers alike either seek to remove the air conditioner before every winter and replace it in the spring, or properly insulate the air conditioner during the winter. Removal of the air conditioner is a back-breaking job, typically requires two strong adults, and requires storage space for the air conditioner once it is removed.

U.S. Pat. Nos. 2,567,915 to Smith; 2,961,846 to Federico; 4,325,229 to DeZurik; 4,332,114 to Goebel; 5,125,197 to Fuchs; and D246,379 to Mueller each disclose different air conditioner covering devices. These devices are all complicated in construction, and difficult to install.

While these units may be suitable for the particular purpose employed, or for general use, they would not be as suitable for the purposes of the present invention as disclosed hereafter.

SUMMARY OF THE INVENTION

It is an object of the invention to produce an air conditioner cover which extends over the front of a conventional window air conditioner during cold weather, and prevents the infiltration of cold air therethrough. Accordingly, the cover includes insulation which effectively prevents heat loss through the air conditioner.

It is another object of the invention to produce an air conditioner cover which has a decorative appearance so that it improves the appearance of the air conditioner front, and does not interfere with the decor of the room in which it is used. Accordingly, the outer surface of the cover may be customized with wood panels or laminates to match the decor of the room.

It is still another object of the invention that the air conditioner cover is simple in construction, so that it is inexpensive to manufacture. Accordingly, the cover attaches onto the air conditioner by means of a seal which extends around the periphery of the cover mouth, which selectively allows the air conditioner to be inserted therein, and then resists removal of the air conditioner therefrom, until a sufficient force is exerted against the seal.

It is a further object of the invention that the seal comprises four angled gaskets which flex against the cover mouth as the air conditioner is inserted therein and then unflex to resist removal of the cover from the air conditioner.

The invention is an air conditioner cover, for covering an air conditioner having an air conditioner face, comprising a main housing defining a main cavity which is sized to cover a portion of the air conditioner rearward of the air conditioner face. The main housing has a front panel, four peripheral walls, and a mouth opening opposite the front panel. A flange extends perpendicular to the peripheral walls at the mouth opening. A seal comprising four angled gaskets extends around the mouth opening, each angled gasket extending from one of the peripheral walls and having a triangular cross section. The angled gaskets allow the air conditioner to easily slide into the mouth opening until the air conditioner face meets the front panel, but resists removal therefrom, to hold the air conditioner cover securely upon the air conditioner. The front panel has a decorative covering to match the decor of the room in which the air conditioner is located.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
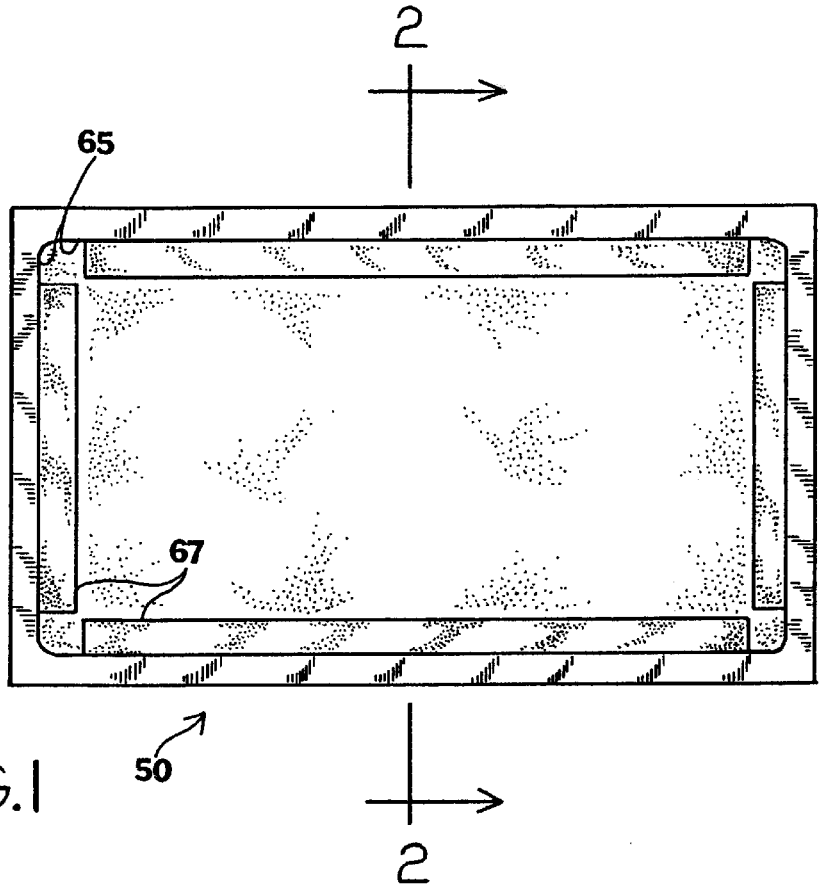
FIG. 1 is a rear elevational view of the air conditioner cover, per se.
Figure 2:
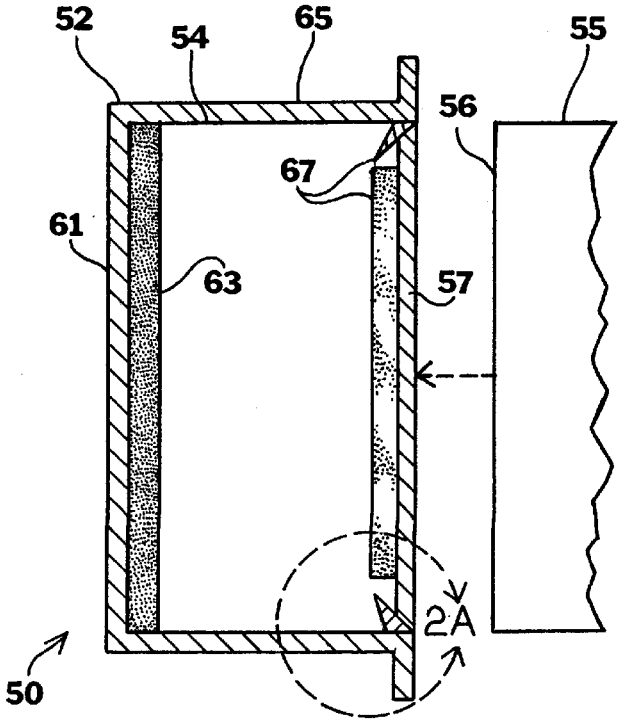
FIG. 2 is a side cross sectional view of the air conditioner cover, taken generally in the direction of arrow 2—2 in FIG. 1.

FIG. 1 and FIG. 2 illustrate an air conditioner cover 50 having a main housing 52, which defines a main cavity 54. The main housing 52 is preferably made of rigid, lightweight material, such as high-impact styrene. The main housing 52 is substantially the shape of a rectangular prism, and thus the main cavity 54 is also the shape of a rectangular prism. The main housing 52 is sized so that the main cavity 54 is large enough to fit over an air conditioner unit 55 having an air conditioner face 56, to cover a portion of the air conditioner 55 rearward of the air conditioner face 56.

The air conditioner cover 50 has a mouth 57, and a flange 59 which extends around the mouth 57, extending outward from the mouth and perpendicular to the main housing 52. The mouth 57 is an open side of the rectangular prism formed by main housing 52. The air conditioner cover 50 comprises a front panel 61 on the main housing 52 which is parallel to and opposite the mouth 57. An insulative sheet 63 is mounted against the front panel 61, inside the main cavity 54. In addition to the front panel 61, the main housing 52 also has four peripheral walls 65.

Figure 2A:
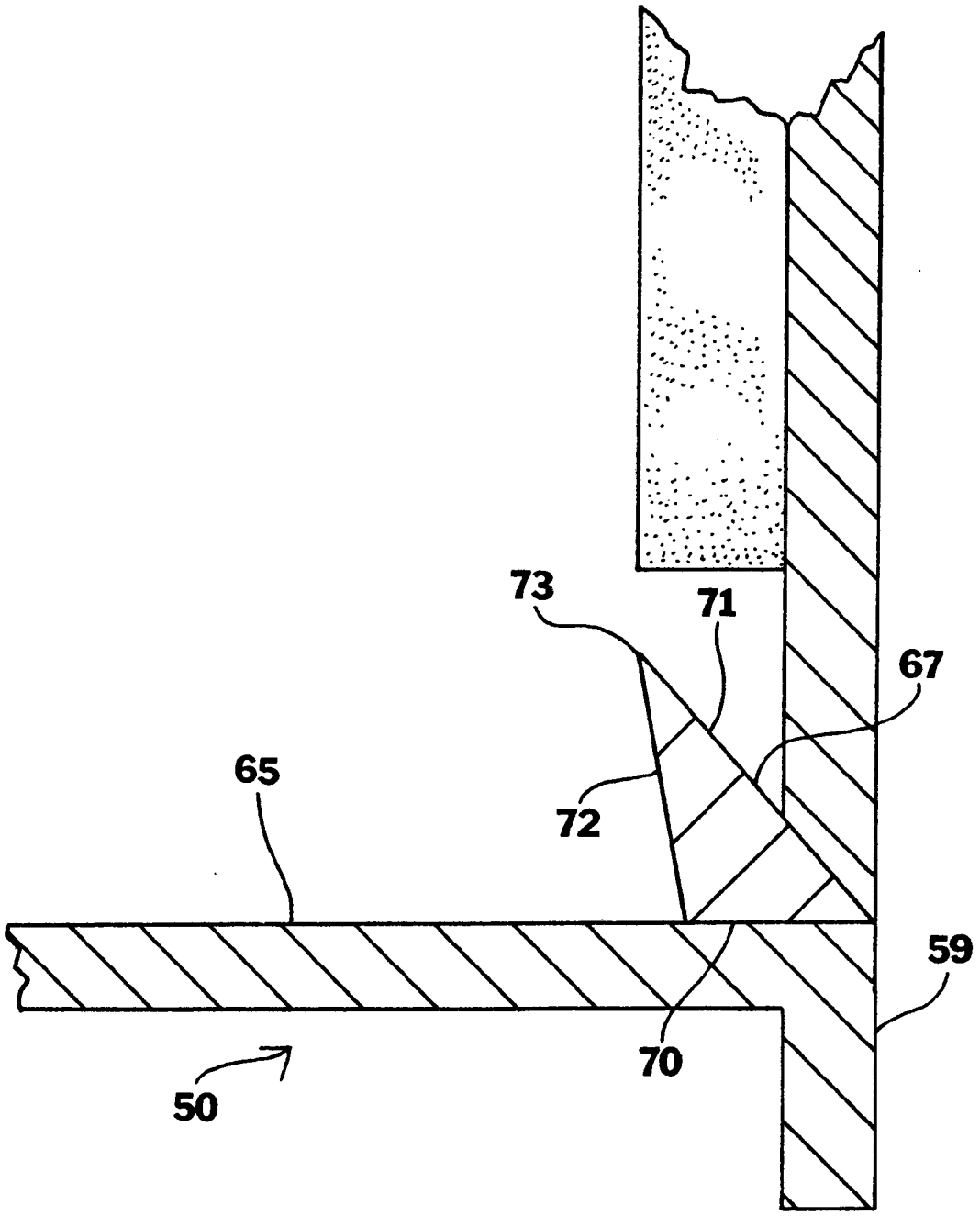
FIG. 2A is an enlarged cross sectional view, taken generally in the area of circle 2A in FIG. 2.

A seal extends inward at the mouth 57. The seal actually comprises four angled gaskets 67, preferably made of foam rubber of the type ordinarily used for cushions, weatherstripping, and air filters. Each of the angled gaskets 67 is attached to one of the peripheral walls 65. Best seen in FIG. 2A, the angled gaskets 67 have a triangular cross section, having a base 70 an outer side 71 an inner side 72, and an apex 73. The apex 73 is opposite the base 70. The base 70 is mounted flush against one of the peripheral walls 65. The outer side 71 forms an acute angle with the base 70. The inner side 72 forms an obtuse angle with the base 70. The inner side 72 and outer side 71 meet at the apex 73.

The gaskets 67 are designed so that as the air conditioner is pushed inward it pushes the inner side 72 downward, and in turn pushes the outer side 71 downward against the peripheral wall 65. The gasket 67 is compressed and the air conditioner is allowed to pass inward into the main cavity, until the air conditioner touches the insulative sheet 63 on the front panel 61. Preferably, as the air conditioner is slid into the mouth opening, the gasket 67 encounters an indenture in the air conditioner which allow the gasket 67 to uncompress slightly.

Although the gaskets 67 easily allow inward movement of the air conditioner, they resist outward movement and thus securely hold the air conditioner in the air conditioner cover 50. Outward movement is resisted by the gaskets 67, because outward movement has a tendency to pull the inner side 72 toward the mouth. This force is translated to a pulling force against the base 70. Thus, the triangular cross-sectional shape of the gasket makes it more difficult to remove the cover 50 than to install it, especially if the gasket 67 comes to rest in an indenture in the air conditioner.

Figure 3:
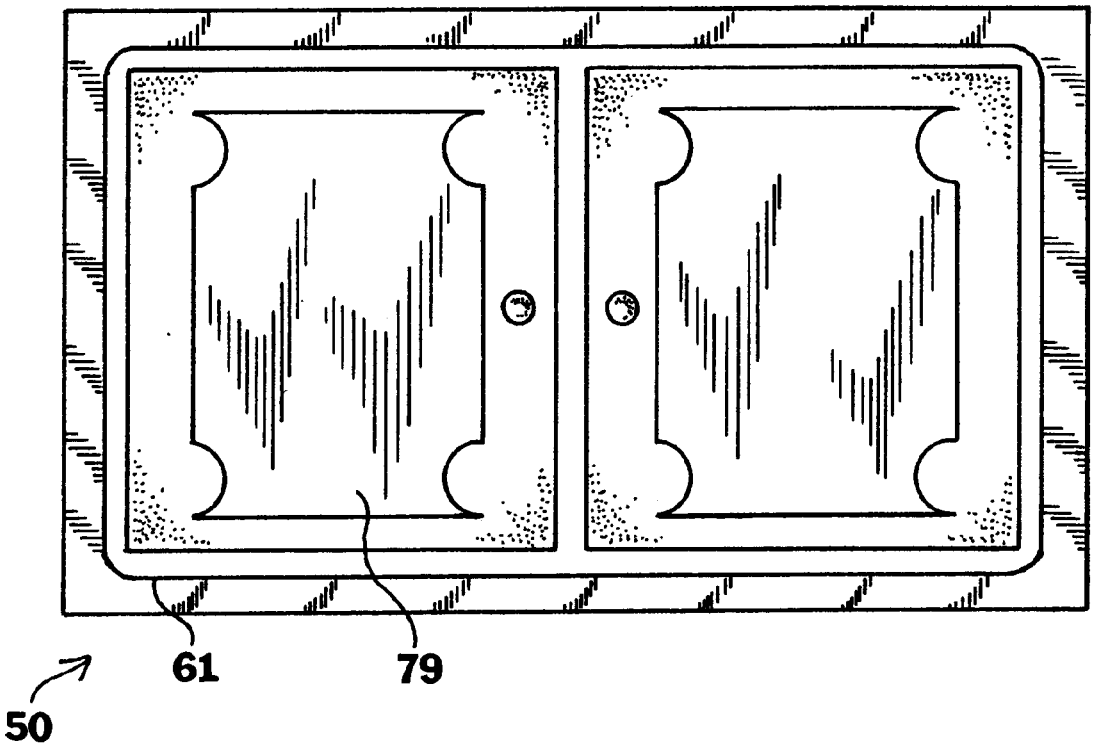
FIG. 3 is a front elevational view of the air conditioner cover, illustrating an exemplative decorative front for the air conditioner cover.

Referring to FIG. 3, the front panel 61 has a decorative front 79. The decorative front may be a carved wood veneer, simulated cabinet doors as illustrated, decorative laminates, wallpaper, or any other decorative covering which would make the air conditioner cover 50 match the room within which it is located.

Although the primary intent of the invention is to cover the air conditioner at the interior of a structure, the air conditioner cover can also be used to cover the air conditioner outside the structure.

In conclusion, herein is presented an air conditioner cover which securely attaches onto the face of an air conditioner during cold weather, to both insulate the air conditioner to prevent cold air infiltration therethrough, and to provide a decorative appearance for the air conditioner.

What is claimed is:

1. An air conditioner cover, for attaching onto an air conditioner having an air conditioner face, comprising:

a main housing, the main housing substantially the shape of a rectangular prism, the main housing defining a rectangular cavity sized to cover a portion of the air conditioner extending from the air conditioner face, the main housing having a mouth opening, a front panel opposite the mouth opening, and four peripheral walls;

a flange extending outward from the main housing at the mouth opening, extending perpendicular to the peripheral walls; and a seal located at the mouth opening for allowing the air conditioner to be inserted into the mouth opening, but resisting removal of the air conditioner from the mouth opening, said seal comprising four angled gaskets, each angled gasket is mounted to one of the peripheral walls and has a triangular cross section having a base which is mounted to the peripheral wall.

2. The air conditioner cover as recited in claim 1, wherein each angled gasket is made of a foam material, has an apex opposite the base, an outer side which forms an acute angle with base, and an inner side which forms an obtuse angle with the base, wherein the inner side and outer side meeting at the apex.

3. The air conditioner cover as recited in claim 2, further comprising an insulative sheet that is mounted against the front panel inside the main cavity.

4. The air conditioner cover as recited in claim 3, further comprising a decorative covering on the front panel opposite the main cavity.

5. The air conditioner cover as recited in claim 4, wherein the main housing is made of a high-impact foam material.

* * * * *